United States Patent [19]

Vince

[11] Patent Number: 4,783,877

[45] Date of Patent: Nov. 15, 1988

[54] HAND-HELD ASSAY WASHER

[75] Inventor: Paul W. Vince, Chantilly, Va.

[73] Assignee: INTI Corp., San Rafael, Calif.

[21] Appl. No.: 816,256

[22] Filed: Jan. 6, 1986

[51] Int. Cl.[4] ..... B08B 9/04

[52] U.S. Cl. ..... 15/302; 15/304; 15/339

[58] Field of Search ..... 15/302, 304, 339, 325; 222/159

[56] References Cited

U.S. PATENT DOCUMENTS

| | | | |
|---|---|---|---|
| 3,949,771 | 4/1976 | Dodge et al. | 15/322 X |
| 4,123,818 | 11/1978 | Hurwitz | 15/339 X |
| 4,341,568 | 2/1982 | Christensen | 15/302 X |
| 4,493,896 | 1/1985 | La Motte, III et al. | 435/287 |
| 4,496,657 | 1/1985 | Coopersmith et al. | 435/287 |
| 4,559,664 | 12/1985 | Bohme et al. | 15/302 |
| 4,635,665 | 1/1987 | Namba et al. | 15/302 X |

FOREIGN PATENT DOCUMENTS

| | | | |
|---|---|---|---|
| 1265324 | 3/1972 | United Kingdom | 222/159 |

OTHER PUBLICATIONS

Product Literature of Skatron, Inc. (Catalog 1983).
Product Literature of A/S Nunc (Date Unknown).
Product Literature of Flow Laboratories (Date Unknown).

*Primary Examiner*—Chris K. Moore
*Attorney, Agent, or Firm*—A. C. Smith

[57] ABSTRACT

A hand-held washer having an upper wall and a lower wall in substantially parallel alignment. Portions of a first sidewall and a second sidewall are tapered toward each other from the upper wall to the lower wall. A first end wall and a second end wall are in substantially parallel alignment. The upper and lower walls and the first and second sidewalls, and the first and second end walls together define a washer body. The washer body is made of a transparent material. An inlet channel is positioned within the washer body for carrying fluid from a source. An outlet channel is positioned within the washer body for applying a vacuum. A plurality of wash tubes descend from the inlet channel through the lower wall. A plurality of aspirator tubes descend from the outlet channel through the lower wall. A valve means connected to the inlet channel controls the flow of fluid through the inlet channel.

4 Claims, 3 Drawing Sheets

Fig. 2
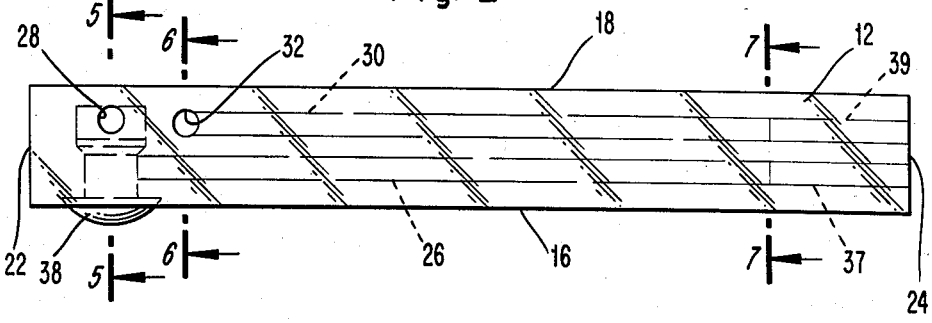
Fig. 3
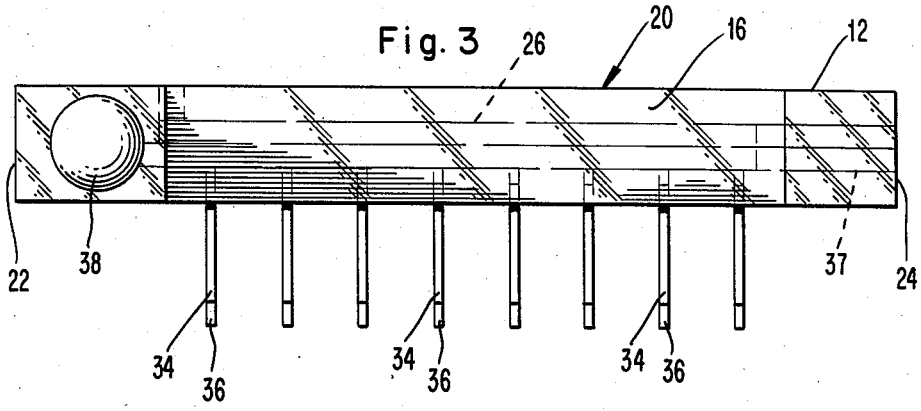
Fig. 4
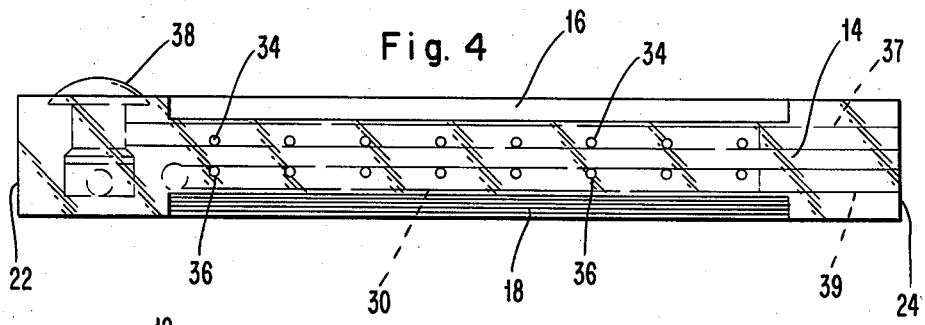
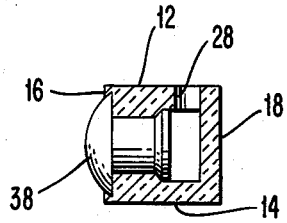
Fig. 5
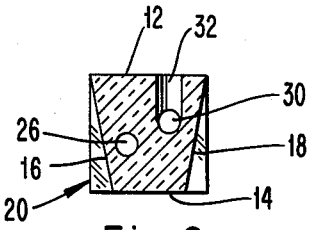
Fig. 6
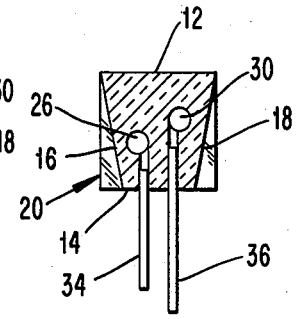
Fig. 7

HAND-HELD ASSAY WASHER

BACKGROUND OF THE INVENTION

The present invention relates to a hand-held washer for beads or to a plurality of containers such as test tubes or multiwell trays and, more particularly, to a hand-held washer for beads, tubes or multiwell trays that is convenient, easy, and effective to use.

Multiwell trays are typically made of molded plastic and have a number of wells in a row and column array. Each well is analogous to a small test tube. For example, a popular multiwell tray is the microplate (also known as a micro-titer or micro-test plate) which has 96 wells in an 8 row by 12 column array.

In various tests or assays, such as an immunoassay test, the exterior surfaces of beads or the interior surfaces of tubes or wells are known as the solid phase. A substance, usually a protein, is physically or chemically attached or bound to the solid phase. This protein has the capability of reacting with or binding to certain other substances. Liquid or suspended chemical reactants are added in a particular sequence such that each will bind to a predecessor if present. This continuation will result in a measurable change in the color of the solution. After the addition of each reactant, the well must be washed or diluted to the extent that only the reactants bound to the solid phase or sandwiched to other bound reactants will remain. (Beads are usually placed within a tube or well to be washed.)

Various problems have arisen with presently available assay washers. Since all presently available assay washers are opaque, bubble or fluid blockage can readily occur in the channels and tubes of the washer without it being detected so that the effective and efficient washing of the solid phase is impeded. Moreover, presently designed hand-held washers do not permit the operator readily to see into the microplate wells to monitor the washing process. Additionally, the tubes projecting from many of these previous washers either scratch the interior of the tubes or wells or, to avoid scratching, are positioned so that they do not touch the bottoms of the tubes or wells, preventing the contents of the tube or well from being completely removed. Accordingly, there is a significant, unmet need for a hand-held washer that efficiently and effectively washes beads, tubes or the wells of a multiwell tray such as a microplate.

SUMMARY OF THE INVENTION

The present invention provides a hand-held washer for beads or a plurality of containers such as test tubes or multiwell trays such as microplates that incorporates several innovations for efficiency, convenience, and safety. A visible fluid path allows bubbles or other blockages in the tubes and channels to be easily detected. A tapered body likewise offers better visibility so that the operator can see into microplate wells being washed.

The present invention achieves these various advantages over previous washers by providing a hand-held washer for beads or a plurality of containers, such as test tubes or multiwell trays such as microplates. The hand-held washer has an upper wall and a lower wall in substantially parallel alignment. A portion of a first sidewall and a second sidewall are tapered toward each other from the upper wall to the lower wall. A first end wall and a second end wall are in substantially parallel alignment. The upper and lower walls, the first and second sidewalls, and the first and second end walls together define a washer body. This washer body is made of a transparent material. An inlet channel is positioned within the washer body for carrying fluid from a source. An outlet channel is positioned within the washer body for applying a vacuum. A plurality of wash tubes descend from the inlet channel through the lower wall. A plurality of aspirator tubes descend from the outlet channel through the lower wall. By varying the length and spacing of these wash and aspirator tubes, various embodiments of the present invention are available for a plurality of containers such as test tubes, vials and various configurations of multiwell plates, including the multiwell microplate described here. A valve means connected to the inlet channel controls the flow of fluid through the inlet channel.

These and other features and advantages of the present invention will be made more apparent from the following description of the preferred embodiments.

BRIEF DESCRIPTION OF THE DRAWINGS

The accompanying drawing, which is incorporated in and constitutes a part of the specification, illustrates various embodiments of the invention and, together with the description, serves to explain the principles of the invention.

FIG. 2 is a top view of the washer of FIG. 1.

FIG. 3 is a front view of the washer of FIG. 1.

FIG. 4 is a bottom view of the washer of FIG. 1.

FIG. 5 is a cross-sectional view taken along line 5—5 in FIG. 2.

FIG. 6 is a cross-sectional view taken along line 6—6 in FIG. 2.

FIG. 7 is a cross-sectional view taken along line 7—7 in FIG. 2.

DETAILED DESCRIPTION OF THE PREFERRED EMBODIMENTS

Figure 1:
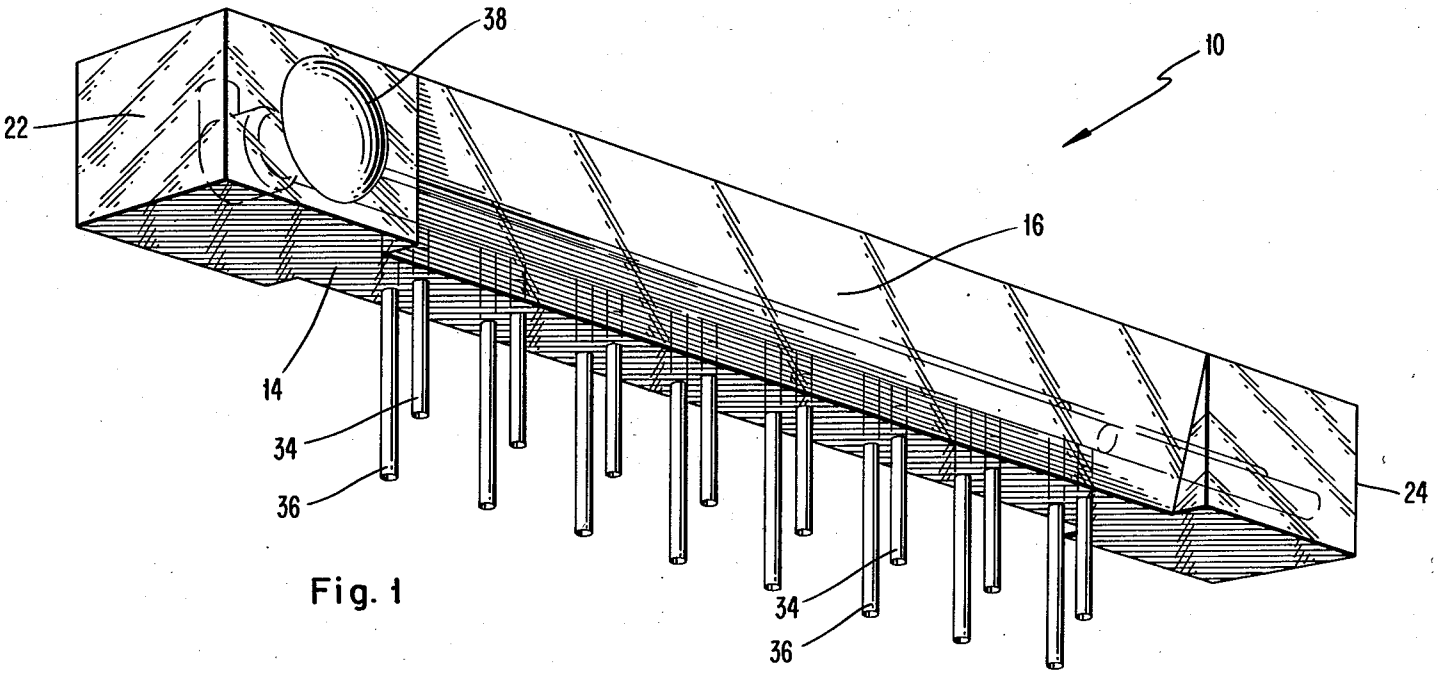
FIG. 1 is a perspective view of a hand-held washer version for microplates of the present invention.

Reference will no be made in detail to the embodiments of the invention, which are illustrated in the accompanying drawings.

In accordance with the present invention, a hand-held washer for beads or a plurality of containers such as test tubes or multiwell trays such as microplates has an upper wall and a lower wall in substantially parallel alignment. A portion of a first sidewall and a second sidewall are tapered toward each other from the upper wall to the lower wall. A first end wall and a second end wall are in substantially parallel alignment. The upper and the lower walls, the first and the second sidewalls, and the first and second end walls together define a washer body that is made of a transparent material.

In one embodiment of the present invention shown in FIGS. 1 to 7, a hand-held washer 10 for microplates has an upper wall 12 and a lower wall 14 in substantially parallel alignment. Portions of a first sidewall 16 and a second sidewall 18 are tapered toward each other from the upper wall 12 to the lower wall 14. The portions of the sidewalls 16 and 18 at each end are not tapered. A first end wall 22 and a second end wall 24 are in substantially parallel alignment. The upper wall 12, the lower wall 14, the first sidewall 16, the second sidewall 18, the first end wall 22 and the second end wall 24 together define a washer body 20.

The upper wall 12, the lower wall 14, the first sidewall 16, the second sidewall 18, the first end wall 22, and the second end wall 24 can be of various sizes depending upon the number and dimensions of the tubes or multiwell trays to be washed. The first sidewall 16 and the second sidewall 18 each form an angle of between about 5° to about 45° with the upper wall 12 so that the sidewalls 16 and 18 are tapered toward each other. As a result, the lower wall 14 has a smaller area than the upper wall 12. By having a tapered body, the washer 10 allows the operator to see into the wells of most multiwell trays.

The washer body 20 is made of a transparent material. Although various transparent materials can be used, a preferred transparent material is polysulfone due to the ability of polysulfone to withstand autoclaving, a popular method of decontamination after exposure to biohazards. In a preferred embodiment of the washer, all of the upper wall 12, the lower wall 14, the first sidewall 16, the second sidewall 18, the first end wall 22, and the second end wall 24 are made of a transparent material. Accordingly, the operator of the washer can readily see the fluid flow through the inlet and outlet channels of the washer to insure that bubbles and blockages are not present that would impede the successful operation of the washer.

In accordance with the present invention, an inlet channel is positioned within the washer body for carrying fluid from a source. As shown in FIGS. 1–7, an inlet channel 26 is positioned within the washer body 20 for carrying fluid from a source. Preferably, the inlet channel 26 lies lengthwise between the end walls 22 and 24 so that the length of the inlet channel 26 runs parallel to the length of the lower wall 14. The inlet channel 26 has an inlet hole 28 in the upper wall 12, as shown in FIG. 2, through which the inlet channel 26 is connected to a The end of the inlet channel 26 which reaches end wall 24 is sealed by a plug 37 which may extend to within ⅛" of the closest wash tube 34 to eliminate space on the inlet channel that can collect air bubbles.

In accordance with the present invention, an outlet channel is positioned within the washer body for applying a vacuum. In one embodiment of the present invention, shown in FIGS. 1 to 7, an outlet channel 30 is positioned within the washer body 20 for applying a vacuum. Preferably, the outlet channel 30 lies lengthwise between the end walls 22 and 24 so that the length of the outlet channel 30 runs parallel to the length of the lower wall 14. The outlet channel 30 has an outlet hole 32 in the upper wall 12, as shown in FIG. 2, through which the outlet channel 30 is connected to a vacuum source. The end of the outlet channel 30 which reaches the end wall 24 is sealed by a plug 39 which may extend to within ⅛" of the closest aspirator tube 36 to eliminate an air space in the inlet channel that can collect air bubbles.

In accordance with the present invention, a plurality of wash tubes descend from the inlet channel through the lower wall. In one embodiment of the present invention shown in FIGS. 1 to 7, a plurality of wash tubes 34 descend from the inlet channel 26 through the lower wall 14. The wash tubes 34 are in substantially parallel alignment and are of the size and shape to fit within the wells of a microplate. For example, each wash tube 34 can be made of stainless steel of 0.825 inch length with a diameter of 0.042 inch. The position, number and length of the wash tubes 34 correspond to the position, number and depth of the tubes or wells to be washed. For example, if the microplate has a row of 8 wells spaced one inch apart, then the washer 10 will be constructed to have a row of 8 wash tubes 34 spaced one inch apart.

In accordance with the present invention, a plurality of aspirator tubes descend from the outlet channel through the lower wall. As shown in FIGS. 1 to 7, a plurality of aspirator tubes 36 descend from the outlet channel 30 through the lower wall 14. The aspirator tubes 36, like the wash tubes 34, are in substantially parallel alignment and are of the number and size to fit the number and shape of tubes or wells being washed. Preferably, the aspirator tubes descend further from the lower wall than the wash tubes and touch the bottoms of the tubes or wells to allow the suction action of the aspirator tubes to remove all fluid from the tubes or wells. Preferably, the aspirator tubes 36 are covered or coated with a material that prevents scratching of the solid phase and can withstand autoclaving, such as polytetrafluoroethylene or a fluorinated ethylene-propylene resin, which are sold under the trademark Teflon TM by E. I. DuPont de Nemours & Co. The use of such a covering or coating forms a sheath which prevents the aspirator tubes 36 from scratching the well bottoms when touching the well bottoms to remove all fluid. The wash tubes 34 could be covered or coated with the non-scratching material, such as Teflon, if there is a danger that they would scratch any portion of the solid phase.

In accordance with the present invention, a valve means is connected to the inlet channel for controlling the flow of fluid through the inlet channel. In one embodiment of the present invention shown in FIGS. 1 to 7, the valve means is a valve 38 that is connected to the inlet channel 26 for controlling the flow of fluid through the inlet channel 26. For example, a one-piece silicone valve that will not corrode or wear out can be used as the valve 38. By pressing the valve 38, the flow of fluid through the inlet channel 26 can be activated.

In operation, wash fluid, usually phosphate buffered saline with a detergent or wetting agent, is introduced via gravity or pressure to the inlet channel 26 of the washer 10 through the inlet hole 28. A one-piece silicone valve 38 controls the supply of fluid to either 8 or 12 wash tubes 34 configured to correspond to the spacing of wells on a standard 96-well microplate. Each of the wash tubes 34 is paired with an aspirator tube 26 through which a common external vacuum source provides continuous suction during the washing process. The wash fluid dilutes the contents of the well and is removed by the suction. This wash/aspirate process is continued or repeated until the unbound reactants are removed to the extent that they will not interfere with subsequent steps of the assay.

Before washing the microplates, the inlet channel should first be purged. The valve 38 should be pressed to flush all air bubbles from the tubing and washer because bubbles can cause uneven washing. The plug 37 in the inlet channel may extend to within ⅛" of the nearest wash tube to facilitate the removal of all air from the inlet channel.

Previously available washers have been subject to internal clogging from at least 2 distinct causes. One cause of clogging is corrosion of internal metal parts due to galvanic action between these metal parts and the metal inlet and outlet tubes or the metal wash and aspirator tubes in the presence of the saline wash fluid. The present design uses no internal metal parts such as plugs in the channels, springs in the valve, or the inlet and outlet channels themselves. The washer body, valve and holder are electrically inert and are not subject to corrosion from galvanic action. Another cause of clogging is the formation of crystals in the fluid path due to evaporation of the saline wash fluid.

Previously available washers have used a short plug to seal the inlet channel so that it is difficult to remove the air from the area between this plug and the nearest wash tube. The present invention can use a long plug which facilitates the complete purging of air from the inlet channel. Purging the air eliminates the wash fluid-/air interface in the inlet channel at which evaporation and crystal formation can occur, particularly during periods of non-use with the wash and aspirator tube tips exposed to air. This can lead to clogging of these tubes due to formation of crystals caused by evaporation of wash fluid.

The especially preferred holder 40 can serve as a reservoir so that the washer can be stored with the tips of the wash and the aspirator tubes immersed in fluid such as water, thereby preventing the evaporation of wash fluid from the wash and aspirator tubes and in turn preventing clogging of the wash and aspirator tubes due to formation of crystals.

Figure 8:
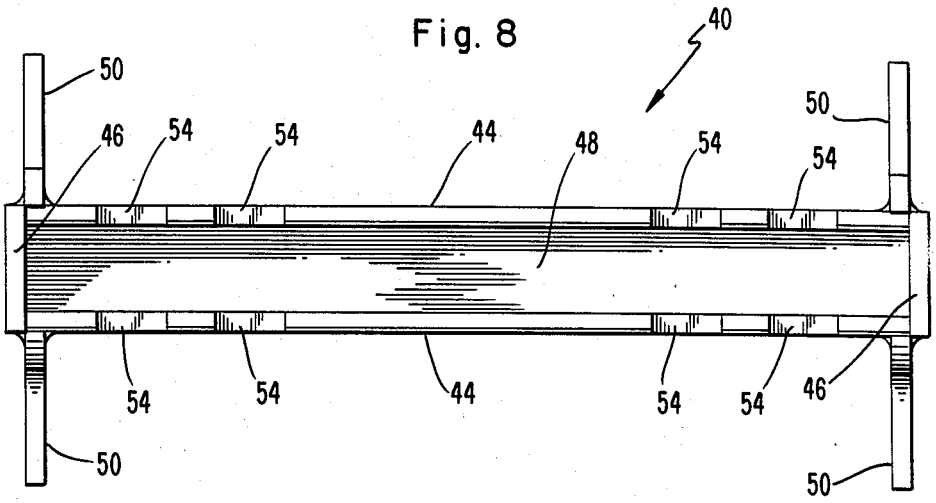
FIG. 8 is a top view of a microplate holder.
Figure 9:
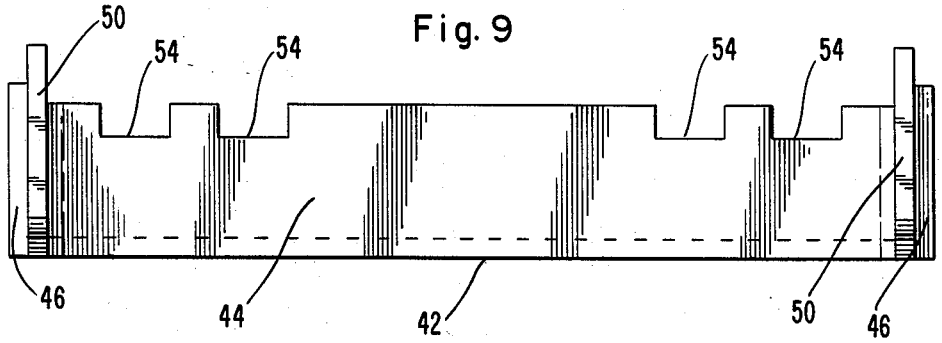
FIG. 9 is a side view of the holder of FIG. 8.
Figure 10:
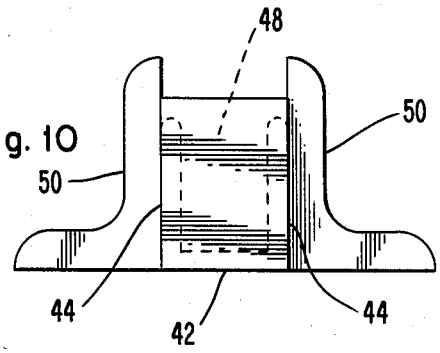
FIG. 10 is an end view of the holder of FIG. 8.

The washer 10 can be used in conjunction with a holder that positions the microplates in proper relationship to the washer 10. Various holders known in the art can be used. However, an especially preferred holder 40 is shown in FIGS. 8–10. The holder 40 has a bottom wall 42 with two substantially parallel sidewalls 44 and two substantially parallel end walls 46 that are substantially perpendicular to the bottom wall 42. The size and shape of the bottom wall 42, the sidewalls 44, and the end walls 46 are selected to correspond to the washer 10 so that the washer 10 rests on the top portion of the side walls 44 and is supported between the end walls 46 to position the wash tubes 34 and the aspirator tubes 36 of the washer 10 into the reservoir area 48 formed between the side walls 44 and the end walls 46. The end walls 46 restrain the washer from sliding beyond the end of the hole.

Stabilizing legs 50 are located perpendicular to and at each end of the sidewalls 44. The top portions of the stabilizing legs 50 project above the sidewalls 44 to secure the washer when it is placed in the holder. The bottom portions of the stabilizing legs 50 extend perpendicularly from the sidewalls 44 to restrain the holder from tipping.

The top edges of the sidewalls 44 contain notches 54 that can hold the side or end of the microplate by positioning the side or end of the microplate onto the notches 54. As a result, the microplate can be supported at an angle, preferably less than 90° with respect to the sidewall during the washing procedure to give the operator a better view of the wells. Also, the positioning of the plates at an angle causes fluid to pool between the bottom and lower side of the wells, facilitating the complete aspiration of the well contents.

It will be apparent to those skilled in the art that various modifications and variations could be made in the present invention without departing from the scope and content of the invention.

What is claimed is:

1. A hand-held washer for beads or a plurality of containers comprising:

an elongated washer body of transparent material having upper and lower walls extending along the elongated length thereof;

an inlet channel extending within the washer body for carrying fluid from a source, the inlet channel being visible through the transparent material of the washer body;

an outlet channel extending within the washer body for supplying suction from a vacuum source, the outlet channel being visible through the transparent material of the washer body;

a plurality of wash tubes, each disposed in fluid communication with and extending from the inlet channel through the lower wall of the washer body at a selected location along the length thereof to a remote tip;

a plurality of aspirator tubes, each disposed in fluid communication with and extending from the outlet channel through the lower wall of the washer body at a selected location along the length thereof to a remote tip, said aspirator tubes descending further form the lower wall than the wash tubes and including covering thereon of non-scratch material extending beyond the remote tips thereof;

sealing means disposed within the washer body to terminate the inlet channel and the outlet channel substantially adjacent the last wash tube or aspirator tube in communication therewith along the lengths thereof to provide self-purging fluid paths in the inlet and outlet channels;

said washer body including side walls between the upper and lower walls that extend substantially along the portion of the elongated length thereof adjacent the selected locations and that taper inwardly over the dimensions of the side walls between the upper and lower walls at an angle substantially in alignment with the remote tips of said tubes to facilitate viewing of the remote tips of at least said aspirator tubes along the corresponding side wall of the washer body; and valve means connected to the inlet channel controlling the flow of fluid therein.

2. The hand-held washer of claim 1, wherein the transparent material is polysulfone.

3. The hand-held washer of claim 1, wherein the sealing means is removable from the inlet and outlet channels to provide access to the channels.

4. The hand-held washer of claim 1 wherein the covering on the aspirator tubes is formed of a material selected from the group consisting of polytetrafluoroethylene and fluorinated ethylene-propylene resins.

* * * * *